United States Patent [19]

Stevenson, IV

[11] Patent Number: 4,864,952

[45] Date of Patent: Sep. 12, 1989

[54] MARINE SAIL SYSTEM

[76] Inventor: William H. Stevenson, IV, P.O. Box U, St. Michaels, Md. 21663

[21] Appl. No.: 162,246

[22] Filed: Feb. 29, 1988

[51] Int. Cl.[4] ..... B63H 9/10

[52] U.S. Cl. ..... 114/102; 114/104

[58] Field of Search ..... 114/39.1, 102, 103, 114/104, 105, 108, 111

[56] References Cited

U.S. PATENT DOCUMENTS 4,365,572 12/1982 Stevenson, IV ..... 114/104

FOREIGN PATENT DOCUMENTS 370196 4/1932 United Kingdom ..... 114/108

*Primary Examiner*—Joseph F. Peters, Jr.
*Assistant Examiner*—Ed Swinehart
*Attorney, Agent, or Firm*—Roylance, Abrams, Berdo & Goodman

[57] ABSTRACT

Marine sail systems for controlling the folding or flaking of the sail during furling or reefing. The system includes a support line, a brailing line, a first mechanism connecting the brailing line to the sail in locations spaced generally along the leech of the sail, and a second mechanism connecting the brailing line to the support line to allow the brailing line to move upwardly and downwardly along the support line as the sail is raised and lowered, respectively.

4 Claims, 2 Drawing Sheets

FIG. 7
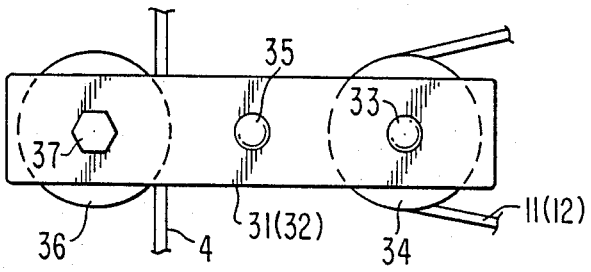
FIG. 8
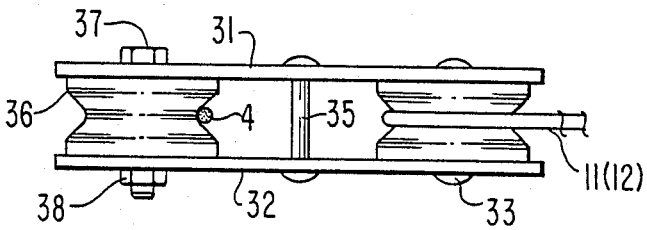
FIG. 10
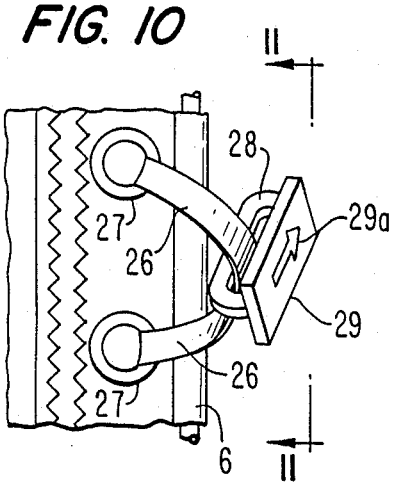
FIG. 9
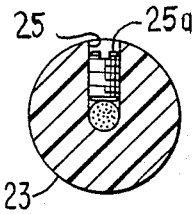
FIG. 1
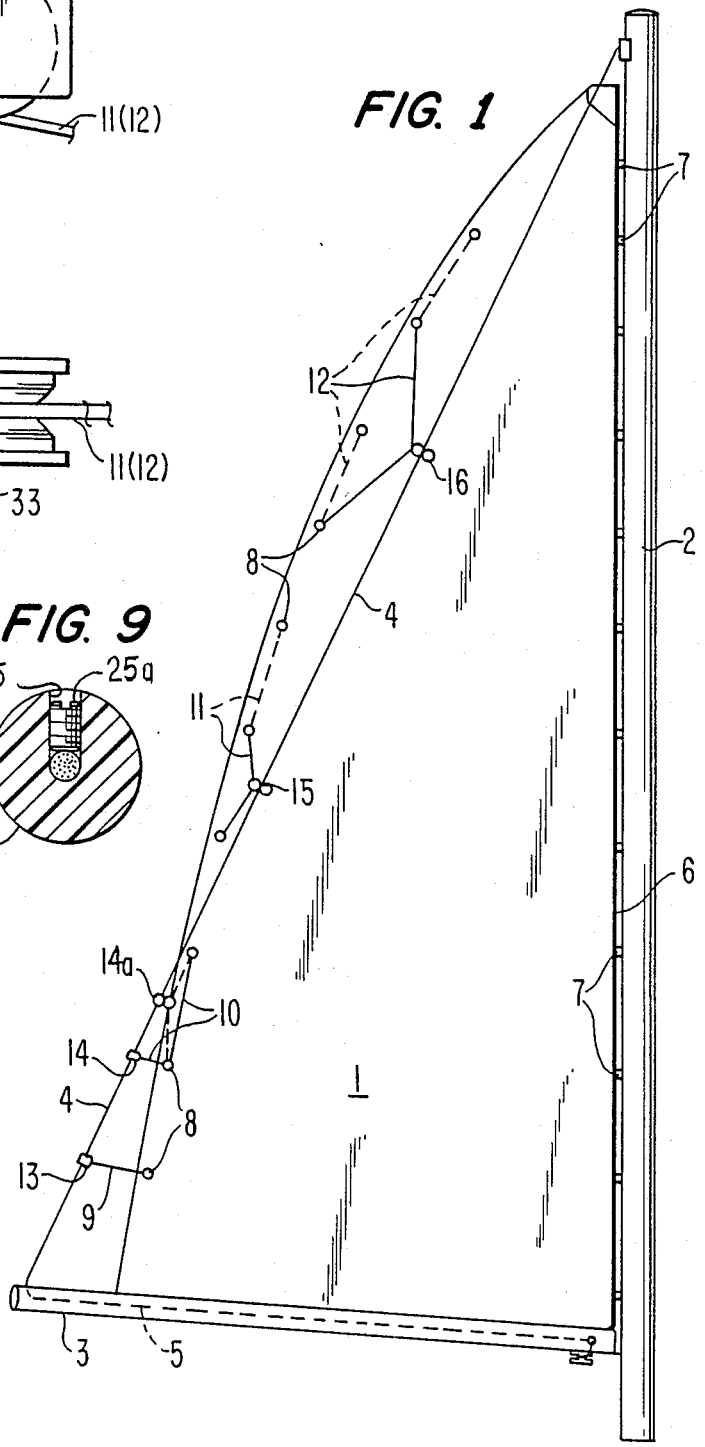
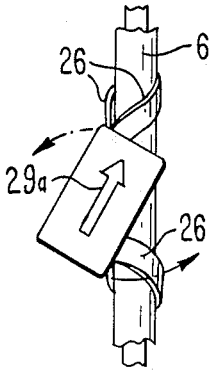
FIG. 11

MARINE SAIL SYSTEM

This invention relates to marine sail systems of the general type in which the sail is supported by a mast and a boom and in which an additional line, which may be a topping lift, extends from the boom to the mast and particularly to improved means for controlling the folding or flaking of the sail during furling or reefing.

BACKGROUND OF THE INVENTION

It is an ancient practice to furl or reef mainsails and like sails by lowering the sail to the boom and folding or flaking the sail on the boom. After the sail has been furled and flaked on the boom, the furled sail is usually covered by a bag or other cover and then remains on the boom, being supported thereby. Often, the sail is simply flaked by hand as it approaches the boom, but this is a task which requires at least one crewman to work at the boom. Prior art workers have therefore attempted to provide ways to cause the sail to flake automatically as it is lowered. One of the earliest of such attempts was to provide lazy jacks, one on each side of the sail, to constrain the sail during lowering, but lazy jacks have at best accomplished only moderate improvement. More recently, lazy jacks, which run upwardly from the foot of the sail and pass on alternate sides of the sail via spaced grommets, have been used in the form marketed by Zip-Stop, Inc. under the trademark READY REEF. The upper ends of the brailing jacks are attached to the topping lift as seen for example in USA patent 4,688,506, issued Aug. 25, 1987 to Martinus van Breeme. While such approaches have achieved commercial success, they have the disadvantage that the lazy jacks tend to impede sail movement and the lazy jacks remain aloft after the sail has been lowered, while also not folding the sail or at least making the sail very difficult to cover, and there has been a continuing need for improvement.

SUMMARY OF THE INVENTION

In its broader aspects, the invention provides brailing means for connecting the trailing portion of a sail to a line running from the boom to the mast, with the brailing means constructed and arranged to control and improve flaking of the sail as it is lowered toward the boom. Advantageously, the line to which the brailing means is connected is a topping lift, though a line other than or in addition to the topping lift can be employed. In particularly advantageous embodiments, the brailing means comprises a plurality of brailing lines so connected to the topping lift or other line as to be capable of free movement therealong as the sail is raised or lowered, the arrangement being such that the brailing lines apply a centering tension to the sail as the sail approaches the boom during reefing or furling. The invention provides new and improved ways to connect brailing lines to a sail, as well as a novel and improved means for sail slide attachment and double block for connecting the brailing lines to the topping lift or other line.

IDENTIFICATION OF THE DRAWINGS

FIG. 1 is a semidiagrammatic elevational view of a sail system according to one embodiment of the invention, with the sail aloft;

FIG. 7 is a top plan elevational view of a separable double block for connecting a brailing line to the topping lift or other line according to the invention;

FIG. 8 is a cross-sectional view taken generally on line 8—8, FIG. 7;

FIG. 9 is a cross-sectional view of a stop for a brailing line;

FIG. 10 is a fragmentary elevational view of a portion of the luff of the sail with a slide attached thereto; and FIG. 11 is an elevational view taken generally on line 11—11, FIG. 10.

DETAILED DESCRIPTION OF THE INVENTION

Figure 2:
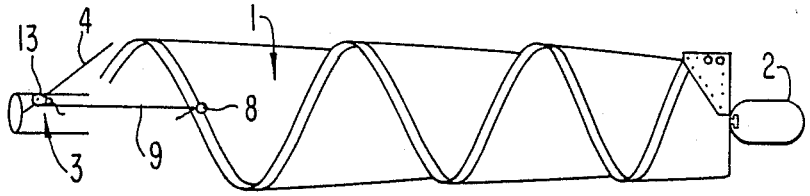
FIGS. 2–5 are top plan elevational views each showing the sail portion to which one of a plurality of brail lines is attached, with the sail substantially furled.

Referring first to FIG. 1, which illustrates one particularly advantageous embodiment of the invention, sail 1 is a mainsail supported by mast 2 and boom 3. A conventional topping lift 4 is connected at its lower end to the boom, as by a line 5 which runs through the hollow boom and can be manipulated by tightening and slacking of the topping lift, the upper end of the topping lift being connected to the mast. Luff 6 of the sail is connected to the mast by a plurality of slides 7 constructed and arranged to be slidably engaged with a track (not shown) extending along the mast. A plurality of grommets 8 are spaced along leech 9 of the sail with each grommet directly opposite a different one of the slides 7. At the leech, the sail is connected to line 4 by a plurality of brailing lines 9-12.

The lowermost brailing line 9 is connected at one end to a conventional single block 13 engaged with line 4, the opposite end of line 9 being connected to the sail by being tied through the lowermost one of grommets 8. Line 10 is also connected at one end to line 4 by a conventional single block 14, the opposite end portion of line 10 extending first through the second of grommets 8, thence upwardly along the sail and being tied to the sail through the third of the grommets. Alternatively, as shown in broken lines, line 10 can have one end tied to the second grommet, the line then running over one sheave of a double block 14a, the other end of the line being tied to the third grommet. Line 11 has one end tied to the sail through the fourth grommet, extends over one sheave of double block 15, then through the fifth grommet of the series and along the sail to the sixth grommet at which the end of the line is tied to the sail. Line 12 has one end tied to the sail through the eighth grommet, then runs down the sail to the seventh grommet, then extends over one sheave of double block 16, thence to the leech and through the ninth grommet, then upwardly to the tenth grommet where the other end of line 12 is tied to the sail. Instead of using single and double blocks, the brailing lines can be simply looped around line 4 to slide therealong as the sail is raised or lowered.

Figure 3:
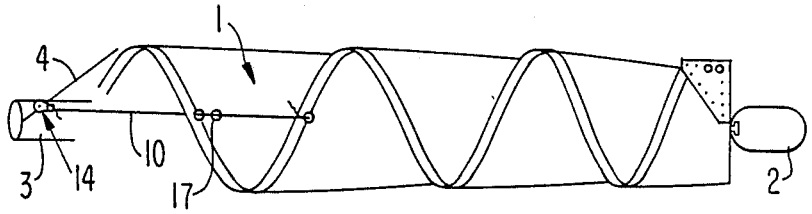
Figure 4:
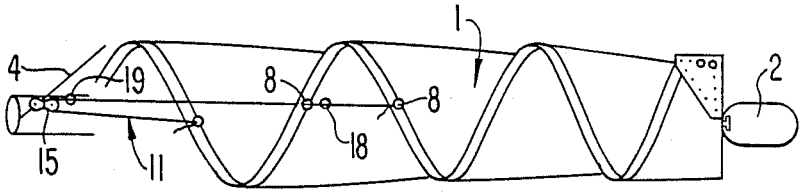
Figure 5:
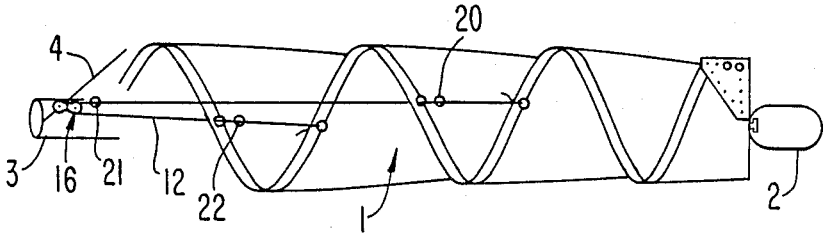
Figure 6:
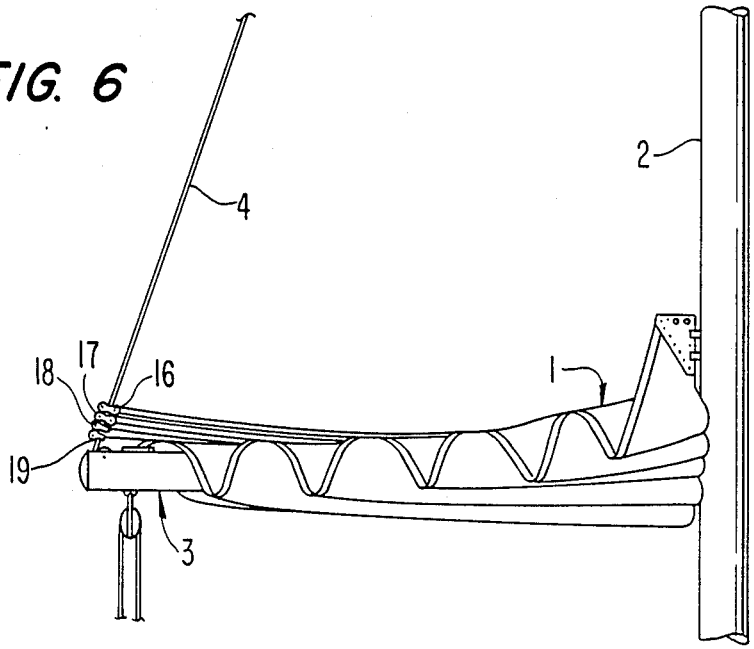
FIG. 6 is a semidiagrammatic elevational view of the sail system after the sail has been flaked.

Line 10 is equipped with a stop member 17 which may be fixed to the line at a point which, as seen in FIG. 3, is spaced from the end of the line tied to the sail by a distance which, as seen in FIG. 3, is only slightly less than the space between the laps of the corresponding fold when the sail is flaked on the boom. Line 11 has a fixed stop member 18 in a position which, as seen in FIG. 4, is slightly less than the space between the fifth and sixth grommets when the sail is flaked. Line 11 also has a second stop member 19 fixed to the line in a position such that, as seen in FIG. 4, is just approaching block 15 when the sail has been flaked. Line 12 has a first stop member 20 fixed to the line so as to be spaced below the eighth grommet and just above the seventh grommet when the sail has been flaked; a second stop member 21 in a location which is just above the sheave of double block 16 when the sail has been flaked, and a third stop member 22 in a location spaced below the tenth grommet by a distance such that stop member 22 is just above the ninth grommet when the sail has been flaked. Each of stop members 17–22 is advantageously in the form of a spherical ball 23, FIG. 9, of rigid polymeric material provided with a bore 24 extending diametrically through the ball to receive the respective line and a threaded radial bore 25 accommodating a set screw 25a which secures the stop member to the line.

Each slide 7 is attached to the luff of the sail by a tape 26 extending through two grommets 27 spaced apart along the luff, the tape extending through bail 2 of the slide and having its end portions sewn together just beyond the bail in such fashion, that, before the sail is installed, the rectangular body 29 of the slide, when viewed from in front of the luff, as in FIG. 11, extends diagonally across the plane of the luff. The angle at which the body of the slide extends slants in one direction for the lowermost slide, in the opposite direction for the next slide, and alternates throughout the series of the slides. When the slides are engaged with the mast track, each slide must be pivoted to bring the slide body, with its arrow 29*a*, into alignment with the luff, as indicated by the broken arrows in FIG. 11. Such pivoting or turning of the slide applies a biasing force tending to bend the boltrope luff tape combination in the direction required for flaking of the sail back and forth.

While various forms of double blocks can be used, that shown in FIGS. 7 and 8 is particularly advantageous. Here the block comprises two rigid plates 31 and 32, a rivet 33 extending through the plates at one end of the block and supporting a sheave 34 to be engaged by one of the brailing lines, a second rivet 35 being provided for purposes of rigidity and separation of lines, and a second sheave 36 being detachably secured to the other end portion of the block by an axle bolt 37 secured with a nylon locking nut 38. When the sail is to be released from line 4, nut 38 is removed, the axle bolt is withdrawn, sheave 36 is removed to free the block from line 4, and the sheave, axle bolt and locking nut are reinstalled, leaving the block connected to the brailing line.

I claim:

1. In a marine sail system of the type which includes a sail having a leech, a luff and a boom for supporting the sail; the sail having means for supporting the luff so that the sail can be lowered and flaked on the boom, the combination of a support line extending from the boom to an upper support;

a plurality of separate brailing lines;

first means, coupled ot each of the brailing liens, for connecting the brailing lines to the sail in locations spaced generally along the leech; and second means, coupled to each of the brailing lines, for slidably connecting the brailing lines to the support line in such fashion as to allow the brailing lines to move upwardly and downwardly along the support line as the sail is raised and lowered, respectively.

2. In a marine sail system of the type which includes a sail having a leech, a luff and a boom for supporting the sail; the sail having means for supporting the luff so that the sail can be lowered and flaked on the boom, the combination of a support line extending from the boom to an upper support;

brailing line means;

first means connecting the brailing line means to the sail in locations spaced generally along the leech; and second means connecting the brailing line means to the support line in such fashion as to allow the brailing line means to move upwardly and downwardly along the support line as the sail is raised and lowered, respectively, the sail being provided with a plurality of apertures spaced generally along the leech and a plurality of slides spaced along the luff with each aperture generally opposite one of the slides, the brailing line means comprising a plurality of brailing lines, and the brailing lines extending through selected ones of the apertures.

3. The combination defined by claim 2, and further comprising a plurality of blocks each having a sheave with which the support line is engaged;

each of the brailing lines being connected with a different one of said blocks.

4. The combination defined by claim 3, wherein at least some of the blocks are double blocks having a first sheave with which the support line is engaged and a second sheave with which a brailing line is connected.

* * * * *